US005332201A

United States Patent [19]

Pöschl

[11] Patent Number: 5,332,201

[45] Date of Patent: Jul. 26, 1994

[54] SYSTEM OF SIZED BRICKS

[75] Inventor: Johann Pöschl, Auersthal, Austria

[73] Assignee: Veitscher Magnesitwerke-Actien-Gesellschaft, Austria

[21] Appl. No.: 11,333

[22] Filed: Jan. 29, 1993

[30] Foreign Application Priority Data

Jan. 31, 1992 [AT] Austria ..... 166/92

[51] Int. Cl.[5] ..... C21B 7/04

[52] U.S. Cl. ..... 266/283; 266/286

[58] Field of Search ..... 266/280, 283, 286, 275; 432/264, 253, 262

[56] References Cited

U.S. PATENT DOCUMENTS 4,673,167 6/1987 Brotzmann et al. ..... 266/283

OTHER PUBLICATIONS

Shamva Mullite Refractory Brick & Special Shapes Catalog No. 102 Jan. 1958.

*Primary Examiner*—Scott Kastler

*Attorney, Agent, or Firm*—John F. A. Earley; John F. A. Earley, III

[57] ABSTRACT

The present invention pertains to a system of sized bricks for lining spherical bottoms, especially of metallurgical vessels, wherein the individual sized bricks are defined by six, essentially flat surfaces, namely, the fire-side surface, the cold-side surface, the two lateral surfaces, as well as the inner and outer surfaces, and the said sized bricks are intended for arrangement in concentric rings wherein the sized bricks within each of these rings join each other with their lateral surfaces, and wherein the outer surfaces of the sized bricks of one ring border on the inner surfaces of the sized bricks of the next ring. A simple modular design is obtained by providing two basic sizes of sized bricks, wherein the sized bricks of the first basic size have a defined distance (r) between the imaginary intersection line of the inner surface with the outer surface and the fire-side surface, and wherein the sized bricks of the second basic size have a defined distance, which is greater than in the case of the first basic size, between the imaginary intersection line of the inner surface with the outer surface and the fire-side surface, and by providing at least three positions within each basic size, wherein the sized bricks of different positions have lateral surfaces which are inclined differently to one another, and wherein the sized bricks of one position have parallel lateral surfaces.

4 Claims, 7 Drawing Sheets

SYSTEM OF SIZED BRICKS

The present invention pertains to a system of sized bricks for lining spherical bottoms, especially of metallurgical vessels, wherein the individual sized bricks are defined by six, essentially flat surfaces, namely, the fire-side surface, the cold-side surface, the two lateral surfaces, as well as the inner and outer surfaces, and the said sized bricks are intended for arrangement in concentric rings, wherein the sized bricks within each of these rings are adjacent to each other with their lateral surfaces, and wherein the outer surfaces of the sized bricks of one ring border on the inner surfaces of the sized bricks of the next ring.

The bottoms of converters and similar vessels for steel-making are usually protected from the thermal effect of the molten steel by a layer of refractory bricks. The individual bricks are joined to one another possibly without gaps and spaces. The bottoms are generally designed as calotte shells, which are surrounded by toroidal segments. To avoid spaces, the necessary dimensions of the individual sized bricks are calculated in prior-art linings. The sized bricks are then made to size, and fitted according to a setting plan. It is obvious that this type of preparation is very expensive.

Systems of sized bricks have also been known, with which the number of necessary bricks of different dimensions can be reduced. In the case of, e.g., calotte shell bottoms, sized bricks are placed in concentric rings around a king brick. Sized bricks of different dimensions are combined with one another in each ring such that the ring will both join the preceding ring without gaps and there will be no gaps between the sized bricks within the ring. All sized bricks of such a system are characterized in that their inner surfaces and their outer surfaces are inclined at an angle $\alpha$ to one another, so that a defined radius of curvature, which corresponds to the radius of the calotte, will be obtained perpendicularly to the plane of the ring. However, it is necessary in such systems to provide a separate series of sized bricks for each calotte radius. This series is determined by the radius of curvature. However, precisely the conversion of the pressing plants to a new series is complicated and expensive in the production of such bricks, because a separate press mold must be prepared and installed in the press. Within one series, it is substantially simpler to prepare bricks of different shapes by adjusting the die and accurately determining the amount of charge.

It has also been known from DE-C 39,40,575 that conical vessel sections can be lined by the oblique installation of commercially available end arches such that increased solidity is achieved. The oblique position is achieved by the installation of deflecting bricks. Processing without gaps is impossible by using only one type of deflecting bricks. This drawback can be tolerated in the case of diameter transitions which are brought about by means of truncated cones with small opening angles, as in the case of the prior-art solution. However, it is not possible to use such a method to line spherical bottoms.

The task of the present invention is to avoid these drawbacks and to provide a system that makes it possible to design spherical and toroidal segment surfaces of any radius, within certain limits, essentially without gaps with a small number of brick shapes. The small gaps, which inherently result from the fact that circular rings are replaced with polygonally defined rings, can be ignored in practice, because each ring is composed of a plurality of individual bricks.

It is therefore provided according to the present invention that two basic sizes of sized bricks are provided, wherein the sized bricks of the first basic size have a defined distance between the imaginary intersection line of the inner surface with the outer surface and the fire-side surface, and wherein the sized bricks of the second basic size have a defined distance, which is greater than in the case of the first basic size, between the imaginary intersection line of the inner surface with the outer surface and the fire-side surface, and at least three positions are provided within each basic size, wherein the sized bricks of different positions have lateral surfaces that are inclined at different angles to one another, and wherein the sized bricks of one position have parallel lateral surfaces.

Due to the inclination of the inner surface to the outer surface, the first basic size is designed such that the minimum calotte radius is obtained by the exclusive use of this basic size. To design a larger calotte radius, it is necessary alternatingly to provide rings consisting of sized bricks of the two basic sizes. If, e.g., the calotte radius is only slightly larger than the minimum radius defined by the first basic size, one ring of the second basic size will have to be inserted in the first basic size each time after three or four rings. The larger the calotte radius, the larger is obviously also the number of rings in the second basic size. Only sized bricks of the same basic sizes are inserted within each ring.

The system according to the present invention makes it possible to cover a broad range of vessel radii with a single set of bricks, and to use machine-pressed sizes without special aftertreatment. Nozzle bricks can be integrated in the selection of shapes without any problem, and it is also possible to design hot-replaceable nozzle bricks. The king brick may be formed from machine-pressed sizes for both loose lining and block lining.

It is advantageous to provide exactly three positions for one partial area of a spherical bottom within each basic size. These three different brick types differ by the wedging of their two lateral surfaces both in the direction perpendicular to the fire-side surface and in the direction perpendicular to the inner surface.

It can be achieved, for example, by suitably mixing bricks of the first and second positions, that a ring will have, on the fire side, the necessary circumference on the inside as well as on the outside. However, it is, in general, impossible to guarantee this on the cold side as well. This becomes possible only by adding sized bricks of the third position. Such addition of sized bricks of the third position can be avoided only if the overall calotte radius exactly corresponds to the radius of the basic size.

In a preferred embodiment of the present invention, the sized bricks of one basic size have inner and outer surfaces that are parallel to one another. This makes it possible to simplify the calculation of the installation plan.

It should be noted in general that the actually last brick of one ring is cut exactly to the size of the remaining gap after all other bricks have been set. The tolerances that inherently develop during installation will thus be compensated as well.

The present invention also pertains to a metallurgical vessel with a steel jacket, which is arched in the form of spherical or toroidal segments in partial areas, and which is provided with a lining consisting of sized bricks. There is provided according to the present invention that the sized bricks are dimensioned at least partly according to the above-described system. Structural weak points in the lining of the vessel can thus be extensively prevented.

The bottom of the vessel is preferably lined with sized bricks, which are arranged in a plurality of rings around a king brick, wherein each ring consists of sized bricks of different positions of a single basic size.

BRIEF DESCRIPTION OF THE DRAWINGS

The present invention will be explained in greater detail below on the basis of the exemplary embodiments represented in the figures. Figures.

Figure 1:
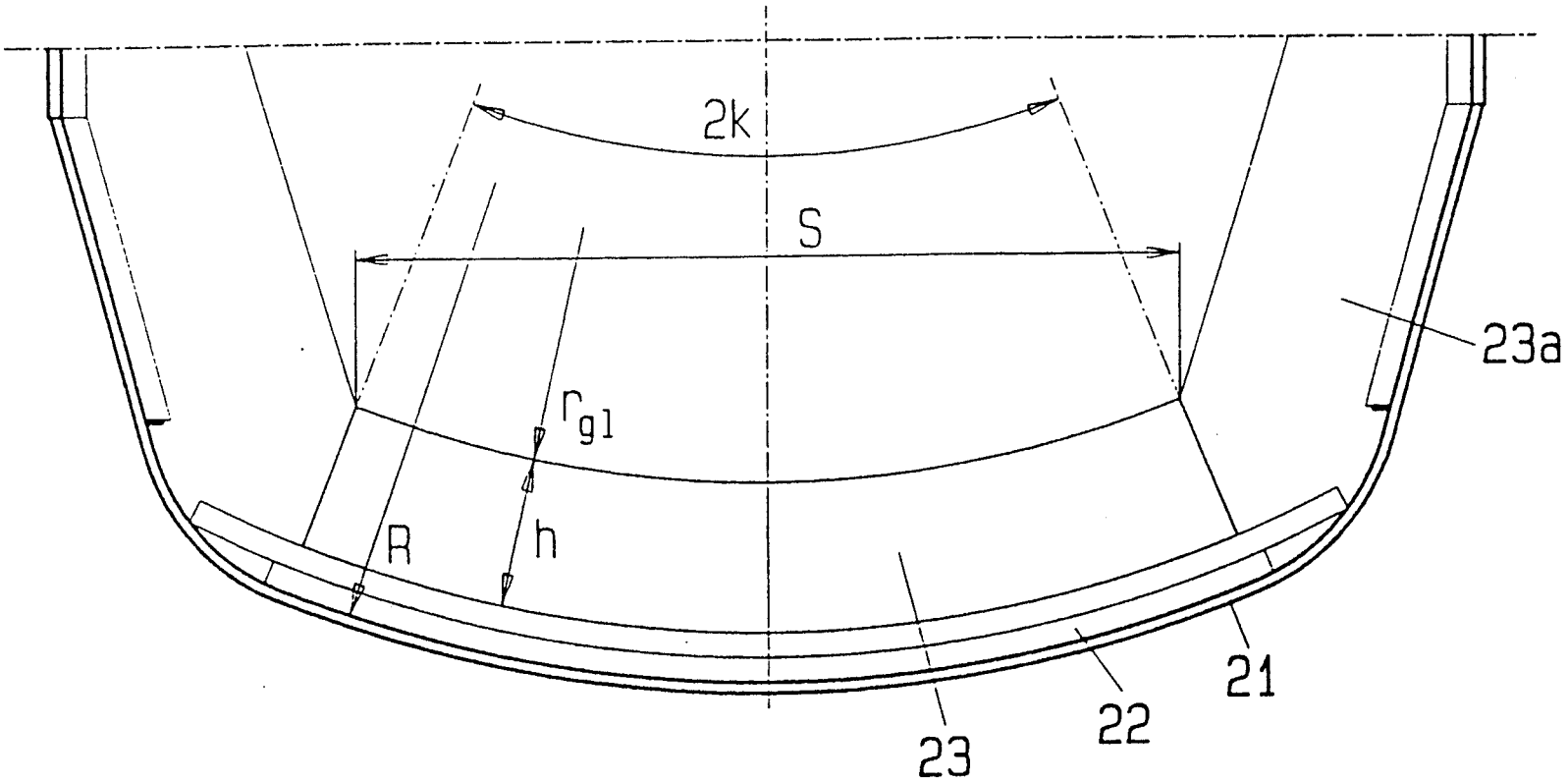
FIG. 1 shows a partial section through a vessel with a spherical bottom.
Figure 2:
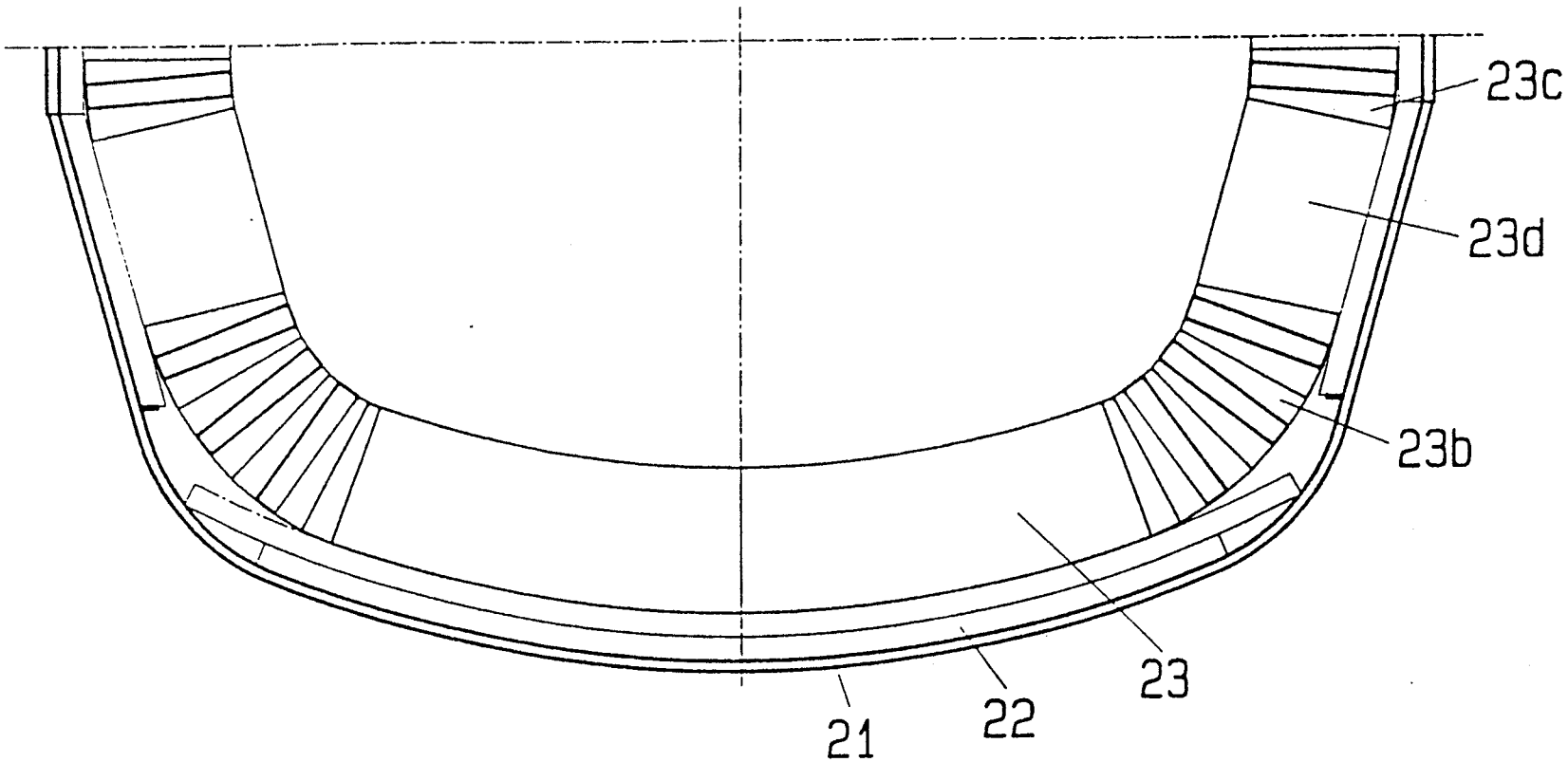
FIG. 2 shows a partial section through a vessel with a spherical bottom with toroidal segments.
Figure 4:
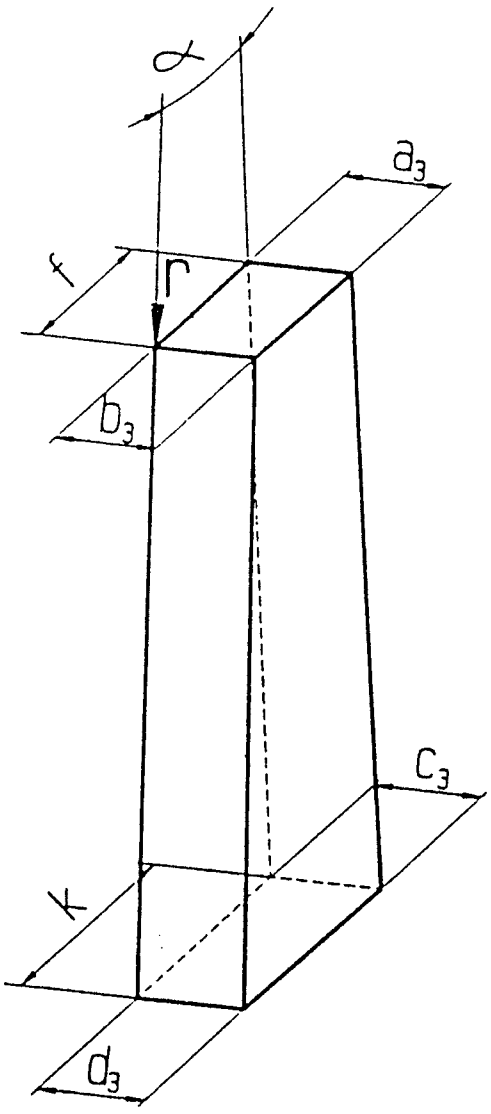
FIGS. 3 and 4 show sized bricks of the first basic size.

The vessels according to FIGS. 1 and 2 consist of a steel jacket 21, which is lined with a permanent lining 22. A lining 23 made of sized bricks is provided on the said premanent lining 22.

The internal radius of the said steel jacket 21 is designated by R, the overall radius on the fire side of the said lining 23 by $r_{gl}$, and the thickness of the said lining 23 by h. The total calotte angle is 2 $\kappa$, and the fire-side chord is designated by s.

In the variant according to FIG. 1, the said lining 23 of the said spherical bottom is joined laterally by the lateral lining 23*a*. In the case of FIG. 2, two toroidal segments 23*b* and 23*c*, between which a conical segment 23*d* is inserted, are provided at the transition from the spherical bottom to the side walls.

Figure 3:
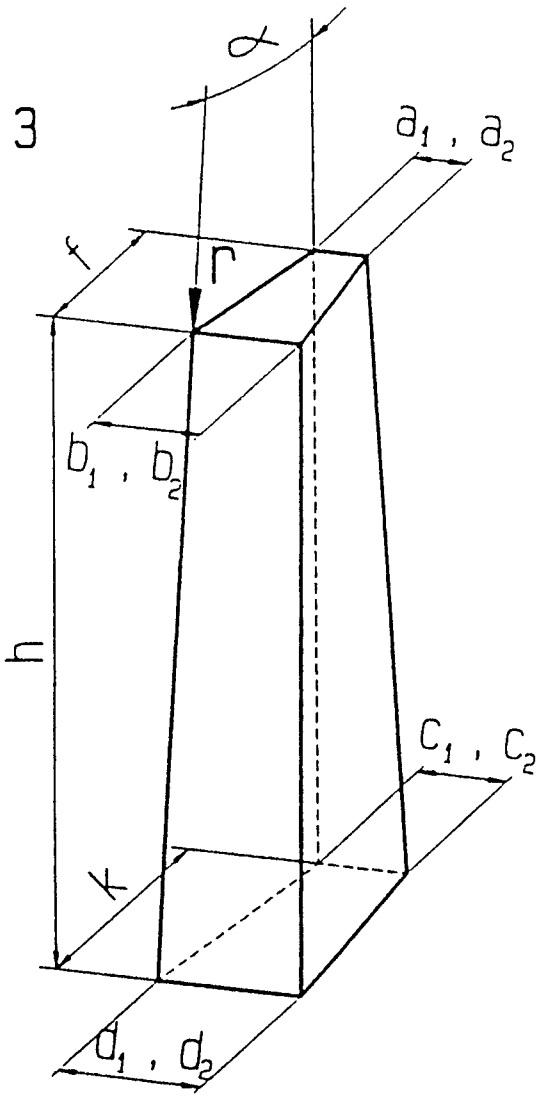

The sized brick according to FIG. 3 is the general form of such a brick of the first or second position of the first basic size. The fire-side surface is trapezoidal, and the inner edge has the length $a_1$ and the outer edge has the length $b_1$ in the brick of the first position. The distance between the inner edge and the outer edge is f. The height h of the brick defines the thickness h of the said lining 23. The cold-side surface is also trapezoidal, and the inner edge has the length $c_1$, and the outer edge has the length $d_1$. The distance between the inner edge and the outer edge is k here. The lateral surfaces, at which the individual bricks of one ring join each other, are also trapezoidal, and have the dimensions f, k, and h. The inner surface with the dimensions $a_1$, $c_1$, and h, as well as the outer surface with the dimensions $b_1$, $d_1$, and h are arranged at an angle $\alpha$ to one another. Taking the dimension f into account, the radius r, which represents the distance between the imaginary intersection line of the inner surface with the outer surface and the fire-side surface, is obtained as a result. This radius r is the characteristic feature for the system of sized bricks. The minimum for the overall radius $r_{gl}$, which can be reached on the fire side of the said lining 23, is also defined by this radius r. By adding to this the brick height h and the thickness of the said permanent lining 22, the minimum for the calotte radius R of the said steel jacket 21, which [minimum] is possible with the system, is obtained.

The sized brick of the second position is not represented separately, because its shape basically corresponds to that of the brick of the first position. Only the dimensions $a_2$, $b_2$, $c_2$ and $d_2$, instead of $a_1$, $b_1$, $c_1$, and $d_1$, are different. These dimensions are modified to the extent that the brick of the second position is wedged less strongly in the direction of the lateral surfaces. Mathematically, this means that $$a_1/b_1 < a_2/b_2 \quad (1)$$

and $$c_1/d_1 < c_2/d_2 \quad (2)$$

The dimensions for the sized brick of the third position will be $a_3$, $b_3$, $c_3$, and $d_3$, instead of the dimensions $a_1$, $b_1$, $c_1$, and $d_1$. However, $$a_3 = b_3 = c_3 = d_3. \quad (3)$$

The other dimensions, f, k, h, and especially r and $\alpha$, are the same for all positions of one basic size.

Figure 6:
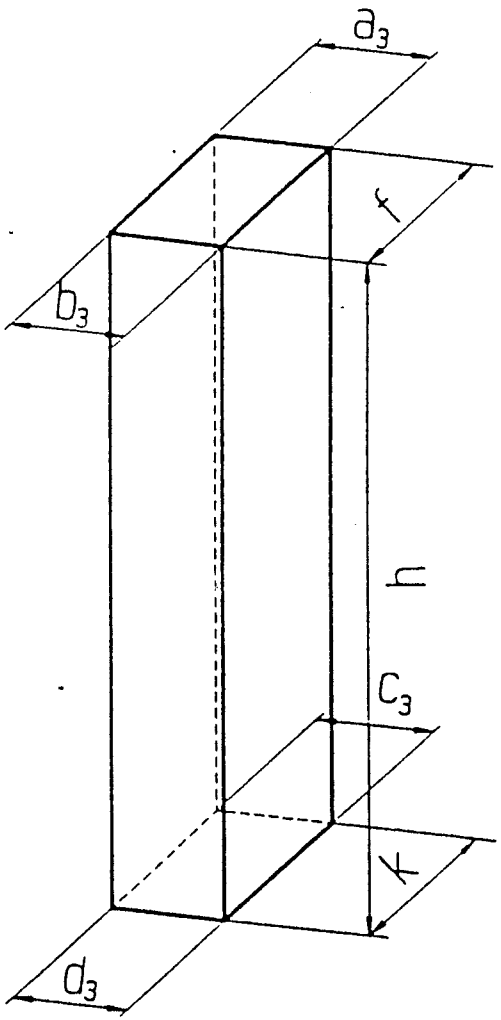
FIGS. 5 and 6 show sized bricks of the second basic size.
Figure 5:
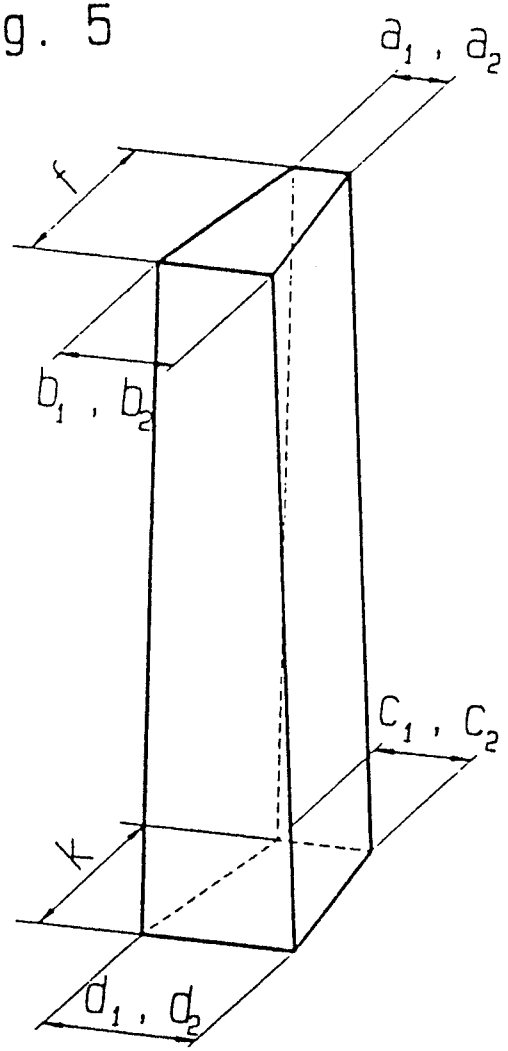

FIGS. 5 and 6 show sized bricks of the second basic size. These are characterized in that the inner surface is parallel to the outer surface. Therefore, $$f = k \quad (4)$$

for all positions of these bricks.

The lateral surfaces are therefore rectangular. The first two positions, which are shown in FIG. 5, again differ only in the dimensions $a_1$, $b_1$, $c_1$, and $d_1$, as well as $a_2$, $b_2$, $c_2$, and $d_2$, and the relations (1) and (2) are valid because of the smaller wedging of the second position.

Now.

$$a_3 = b_3 = c_3 = d_3 \quad (3)$$

applies to the brick of the third position, from which follows that this brick is a right parallelepiped.

Figures 7, 8:
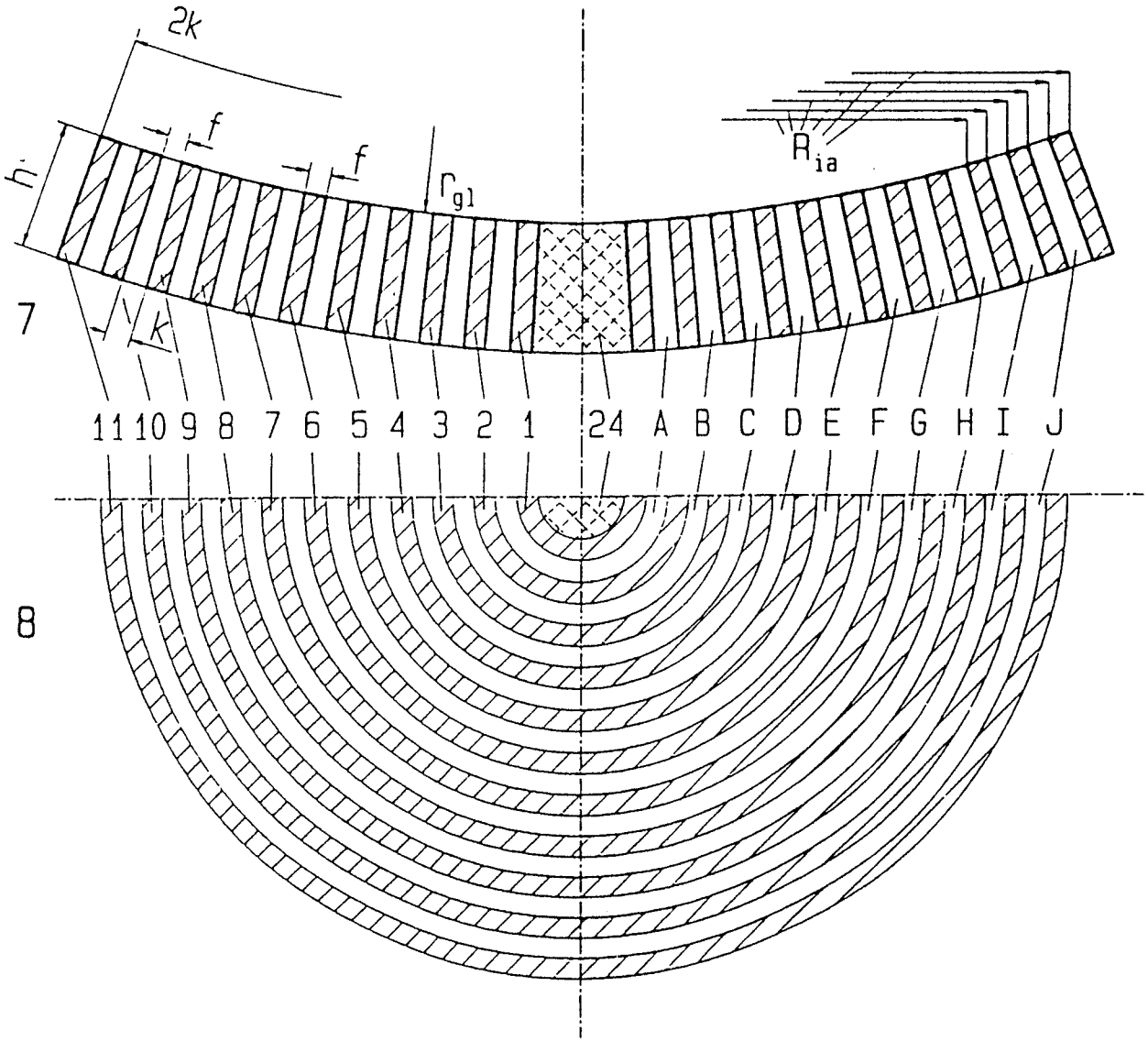
FIG. 7 shows schematically a sectional view of a variant.
FIG. 8 shows a top view to FIG. 7.

FIGS. 7 and 8 show an example of a said lining 23 of a spherical bottom, in which the overall radius $r_{gl}$ is approximately double the radius r of the first basic size. Therefore, rings 1, 2, 3, 4, etc., of the first basic size are arranged concentrically to the king brick, alternatingly with rings A, B, C, D, etc., of the second basic size, and the condition $$r_{gl} = 2\,r \quad (5)$$

is guaranteed due to the 1:1 ratio.

EXEMPLARY EMBODIMENT

It will be shown in the following example how a system of sized bricks is designed and dimensioned. The minimum overall radius $r_{gl}$, to which the system is applicable, must first be established. This value is assumed to be 2,500 mm in this case.

Thus, $$r = 2{,}500 \text{ mm}$$

is established for the first basic size. Further, $h=500$ mm and $f=100$ mm are established based on practical considerations. Now, the following values can be calculated:

$k=120$ mm and $\alpha=2.29°$.

For the second basic size:

$h=500$ mm and $f=k=100$ mm.

The further dimensions of the individual positions of the first basic size are now determined. For instance, the following values are selected for the further dimensions:

$a_1=50$ mm,
$b_1=99.9$ mm,
$c_1=60$ mm,
$d_1=119.9$ mm.

Thus, the following calculated radii are obtained:

$R_{1a}=100$ mm,
$R_{1b}=199.8$ mm,
$R_{1c}=120$ mm,
$R_{1d}=239.8$ mm.

Here, $R_{1a}$ is the radius at the fire-side inner edge of the first ring. $R_{1b}$ is the radius at the fire-side outer edge of the first ring, and $R_{1c}$ and $R_{1d}$ are the corresponding values for the cold side.

The sized bricks of the second position are designated by numeral 7 in this example, because they are designed to be used unmixed in the seventh ring of a calotte with a radius of 2,500 mm. The following dimensions are now obtained:

$a_7=50$ mm,
$b_7=56.9$ mm,
$c_7=60$ mm,
$d_7=68.3$ mm, and $R_{7a}=690.9$ mm,
$R_{7b}=786.5$ mm,
$R_{7c}=829.1$ mm,
$R_{7d}=943.8$ mm.

The equation $$a_S=b_S=c_S=d_S=50 \text{ mm}$$

applies to the third position, which is generally called an "compensation brick."

The further dimensions of the individual positions of the second basic size are now determined, and the first position is designated by A and the second position by G. The third position is again the compensation brick S.

The dimensions are:

$a_A=50$ mm,
$b_A=100$ mm,
$c_A=60$ mm,
$d_A=110$ mm, and further, $a_G=50$ mm,
$b_G=57$ mm,
$c_G=60$ mm,
$d_G=67$ mm, as well as $a_S=b_S=c_S=d_S=50$ mm.

The following dimensions, which are relevant for the design of a lining, can now be derived for the first seven rings:

TABLE 1

| RING | $l_i$ | $R_{ia}$ | Quantity Pos. 1 | Quantity Pos. 7 | $l_i$ | Quantity Pos. A | Quantity Pos. G |
|---|---|---|---|---|---|---|---|
| 1/A | 139.8 | 100.0 | 12.6 | 0 | 119.9 | 12.6 | 0 |
| 2/B | 159.4 | 199.8 | 10.7 | 14.6 | 139.5 | 10.6 | 14.7 |
| 3/C | 178.7 | 299.3 | 8.5 | 29.2 | 158.9 | 8.4 | 29.3 |
| 4/D | 197.7 | 398.3 | 6.4 | 43.8 | 178.4 | 6.4 | 43.8 |
| 5/E | 216.4 | 496.7 | 4.3 | 58.2 | 197.0 | 4.1 | 58.4 |
| 6/F | 234.8 | 594.3 | 2.1 | 72.1 | 215.6 | 2.0 | 72.7 |
| 7/G | 252.8 | 690.9 | 0 | 86.8 | 234.3 | 0 | 86.8 |

Figure 9:
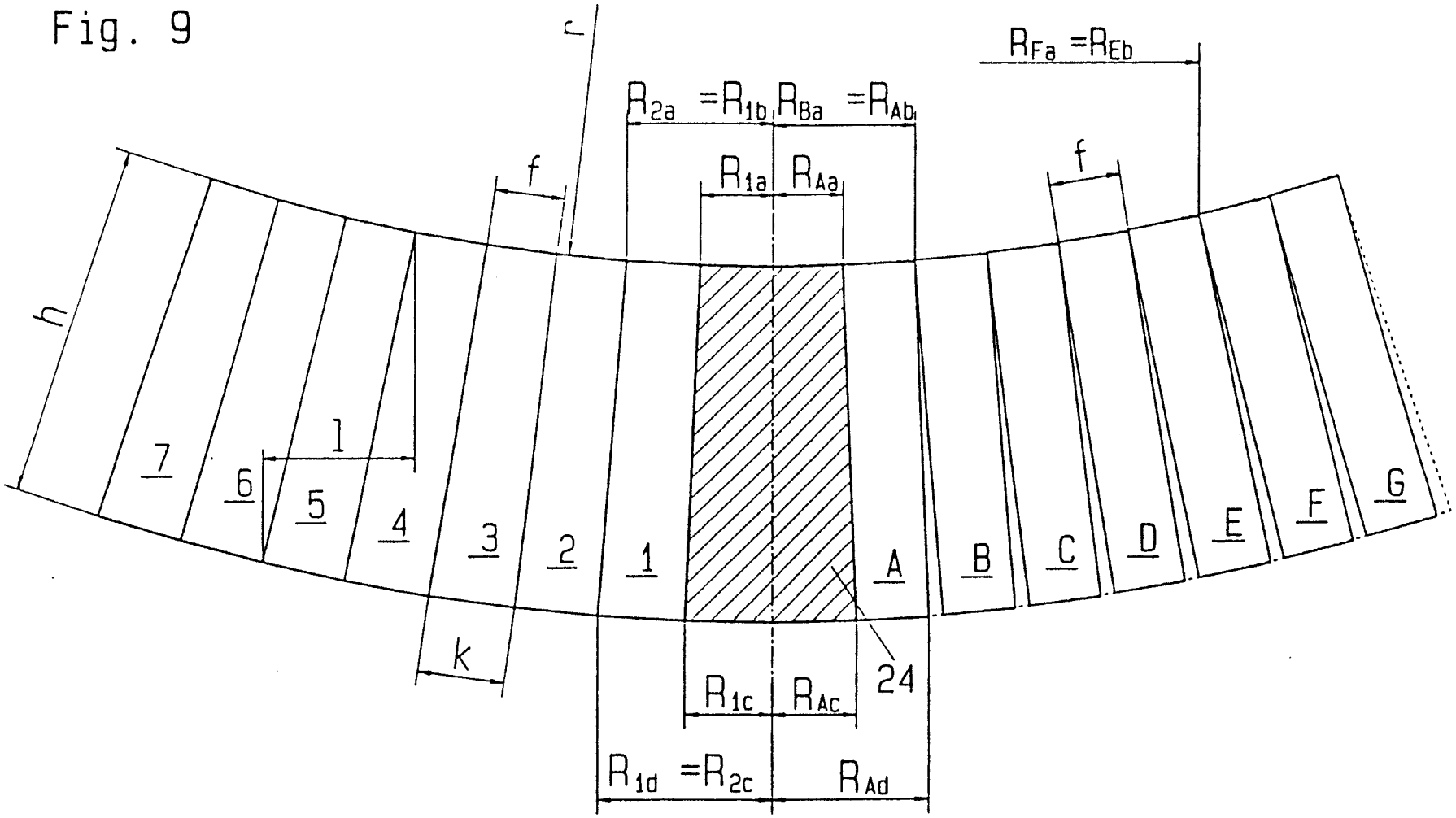
FIG. 9 shows a schematic representation for the installation.

$l_i$ is the difference of the calculated radii $R_{id}$ and $R_{ia}$ of the i-th ring. Figure 9 shows $l_5$. The calculated radii $R_{ia}$ are equal for the rings 1, 2, 3 . . . of the first basic size and for the rings A, B, C . . . of the second basic size.

The quantities for the positions 1 and 7 as well as A and G, which indicate the mixing ratio, are selected to be such that the sized bricks of one ring join each other without gaps. This means that the conditions:

$U_{ia}=\Sigma a_i=2\pi R_{ia}$,
$U_{ib}=\Sigma b_i=2\pi R_{ib}$,
$U_{ic}=\Sigma c_i=2\pi R_{ic}$, and
$U_{id}=\Sigma d_i=2\pi R_{id}$ are satisfied for all rings $i=1, 2, 3 \ldots$ and $i=A, B, C \ldots$ These equations indicate that the sums of all values for the dimension $a_i$ (or $b_i$, $c_i$ or $d_i$) of the two positions 1 and 7 are equal, in terms of the quantity according to Table 1 of one ring, to the circumference that is obtained from the calculated radius.

However, as is apparent from FIG. 9, the bricks A and G of the second basic size are not suitable for preparing a gap-free connection of the individual rings.

Therefore, the relationship $$R_{id}=R_{(i+1)c}$$

is satisfied only for the rings $i=1, 2, 3 \ldots$ but not for $i=A, B, C \ldots$. However, the condition $$R_{ib}=R_{(i+l)a}$$

is valid in both cases. The non-integer values for the quantities of the respective bricks represent no problems in practice, because the last brick of one ring is always cut on site accurately according to the measured gap. This is necessary, because tolerances in manufacture cannot be ruled out.

The lining for a calotte radius of $r_{gl}=3{,}953$ mm shall now be put together. The mixing ratio for the two basic sizes is first determined. The mixing ratio M is obtained from $$M=r/(r_{gl}-r)=2{,}500/(3{,}953-2{,}500)=1.7.$$

This means that the ratio of rings of the first basic size to rings of the second basic size shall equal 1.7:1. The first 10 rings are therefore established as follows:

| | |
|---|---|
| Ring X1 | basic size 1 (position 1) |
| Ring X2 | basic size 2 (positions A, G) |

-continued

| | |
|---|---|
| Ring X3 | basic size 1 (positions, 1, 7, S) |
| Ring X4 | basic size 1 (positions 1, 7, S) |
| Ring X5 | basic size 2 (positions A, G, S) |
| Ring X6 | basic size 1 (positions 1, 7, S) |
| Ring X7 | basic size 1 (positions 1, 7, S) |
| Ring X8 | basic size 2 (positions A G, S) |
| Ring X9 | basic size 1 (positions 1, 7, S) |
| Ring X10 | basic size 1 (positions 7, S). |

If additional rings are needed, which join ring X10 on the outside, another, slightly wedged position, not shown, is provided for each basic size. These positions are mixed with the positions 7 and s for the first basic size and with G and S for the second basic size in this outer area of the said lining 23.

Figure 10:
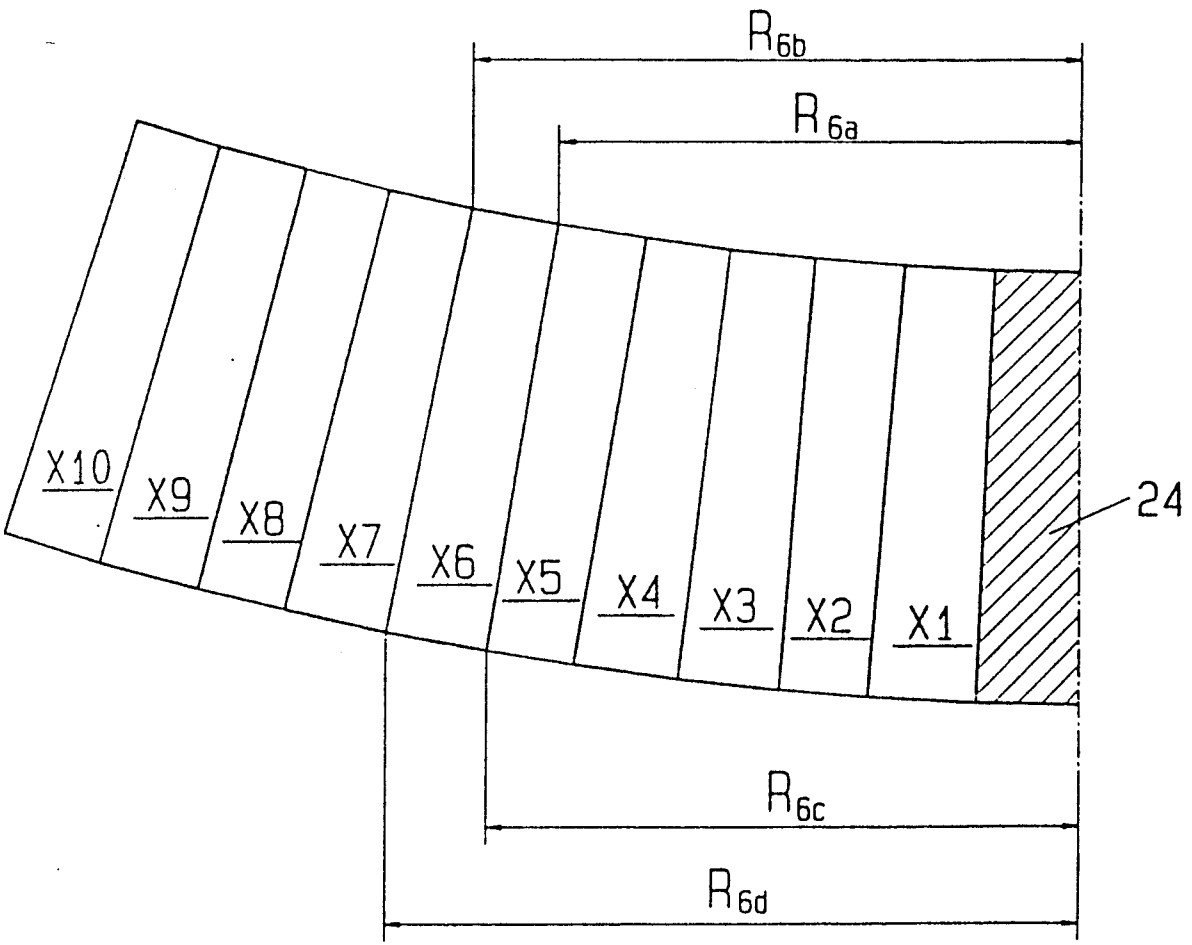
FIG. 10 shows schematically a sectional view of another variant.

The dimensioning of ring X6 will now be explained as an example. The calculated radii and consequently also the corresponding circumferences result from the geometry according to FIG. 10:

| | |
|---|---|
| $R_a$ = 596.7 mm | $U_a$ = 3,749 mm, |
| $R_b$ = 695.7 mm | $U_b$ = 4,371 mm, |
| $R_c$ = 676.5 mm | $U_c$ = 4,251 mm, |
| $R_d$ = 795.5 mm | $U_d$ = 4,998 mm. |

Ring X6 is the fourth ring of the first basic size, and its angular position therefore corresponds to ring 4 from Table 1. As can be determined from this table, 6.4 bricks of the first position and 43.8 bricks of the second position are to be used. The following values are obtained from the dimensions of these bricks:

$\Sigma a = 2{,}510$ mm, $\Sigma b = 3{,}132$ mm, $\Sigma c = 3{,}012$ mm, $\Sigma d = 3{,}759$ mm.

Using the circumferences calculated above and subtracting these values from them, we obtain:

$$U_a - \Sigma a = U_b - \Sigma b = U_c - \Sigma c = U_d - \Sigma d = 1{,}239\text{mm}.$$

It is easy to see that this deficiency can be compensated by adding 24.8 outbond (compensation) bricks s, for which $$a = b = c = d = 50 \text{ mm}.$$

Consequently, the final composition of this ring 6 is:

| | |
|---|---|
| 6.4 pieces | position 1 |
| 43.8 pieces | position 7 |
| 24.8 pieces | position s. |

The other rings can be dimensioned analogously. The following values in Table 1 are used to determine the number of sized bricks of the first and second position of the rings:

| | |
|---|---|
| Ring X1: | Ring 1 |
| Ring X2: | Ring B |
| Ring X3: | Ring 2 |
| Ring X4: | Ring 3 |
| Ring X5: | Ring D |
| Ring X6: | Ring 4 |
| Ring X7: | Ring 5 |
| Ring X8: | Ring F |
| Ring X9: | Ring 6 |
| Ring X10: | Ring 7 |

I claim:

1. A lining of a spherical bottom of a metallurgical vessel, comprising a system of sized bricks wherein the individual sized bricks are defined by six, essentially flat surfaces, namely, the fire-side surface, the cold-side surface, the two lateral surfaces, as well as the inner and outer surfaces, and the said sized bricks are arranged in concentric rings, wherein the sized bricks within each of these rings join each other with their lateral surfaces, and wherein the outer surfaces of the sized bricks of one ring border on the inner surfaces of the sized bricks of the next ring, wherein two basic sizes of sized bricks are provided, wherein the sized bricks of the first basic size have a defined distance (r) between the imaginary intersection line of the inner surface with the outer surface and the fire-side surface, and wherein the sized bricks of the second basic size have a defined distance, which is greater than in the case of the first basic size, between the imaginary intersection line of the inner surface with the outer surface and the fire-side surface, and that at least three positions are provided within each basic size, wherein the sized bricks of different positions have lateral surfaces which are inclined differently to one another, and wherein the sized bricks of one position have parallel lateral surfaces.

2. The lining in accordance with claim 1, wherein exactly three positions are provided within each basic size for one partial area of one spherical bottom.

3. The lining in accordance with one of the claim 1, wherein the sized bricks of one basic size have inner and outer surfaces that are parallel to one another.

4. The lining in accordance with claim 2, wherein the sized bricks of one basic size have inner and outer surfaces that are parallel to one another.

* * * * *